US007986890B2

(12) United States Patent
Murakami

(10) Patent No.: US 7,986,890 B2
(45) Date of Patent: Jul. 26, 2011

(54) IMAGE FORMING APPARATUS AND METHOD OF SETTING PRINTING CONDITION IN THE SAME

(75) Inventor: Reiji Murakami, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1124 days.

(21) Appl. No.: 11/741,054

(22) Filed: Apr. 27, 2007

(65) Prior Publication Data

US 2008/0267644 A1 Oct. 30, 2008

(51) Int. Cl.
*G03G 15/00* (2006.01)

(52) U.S. Cl. ..... 399/45; 399/69

(58) Field of Classification Search ..... 399/45, 399/67, 69, 81
See application file for complete search history.

(56) References Cited

U.S. PATENT DOCUMENTS 6,381,422 B1 * 4/2002 Tanaka ..... 399/45
6,718,145 B2 4/2004 Ohta et al.
6,996,349 B2 2/2006 Ohta et al.
2004/0246519 A1 12/2004 Hooper, III et al.
2006/0024075 A1 * 2/2006 Watanabe ..... 399/45

FOREIGN PATENT DOCUMENTS

JP 08220929 A * 8/1996
JP 2003-029581 1/2003
JP 2003-084507 3/2003

OTHER PUBLICATIONS

Chinese Office Action for 200810094079.3 mailed on Oct. 30, 2009.

* cited by examiner

*Primary Examiner* — David M Gray
*Assistant Examiner* — Laura K Roth
(74) *Attorney, Agent, or Firm* — Turocy & Watson, LLP

(57) ABSTRACT

Using an operation panel a user selects group to which a recording medium to be subjected to image formation belongs out of plural groups of recording media classified according to grammages, a classification processing unit sub-classifies the group selected, to which the recording medium belongs, into plural sub-groups of recording media according to a detecting result of the media sensor provided further upstream in a conveying direction of a recording medium than a fixing unit, and a control unit sets, for the recording medium belonging to the group selected, the temperature of the fixing unit to a fixing temperature in a fixing temperature range and controls this fixing temperature according to any one of the sub-groups sub-classified. Consequently, it is possible to perform fixing processing at an optimum temperature according to a type of a recording medium.

10 Claims, 5 Drawing Sheets

| PAPER TYPE | GRAMMAGE DIVISION (g/m²) | GRAMMAGE (g/m²) | DISTRIBUTION JAPAN | DISTRIBUTION NORTH AMERICA | DISTRIBUTION EUROPE | REAM WEIGHT BY KILOGRAM (kg) | REAM WEIGHT BY U.S. POUND (lbs.) |
|---|---|---|---|---|---|---|---|
| PLAIN PAPER | 64～105 | 64.0 | ○ | | | 55 | |
| | | 75.3 | | ○ | | | 20(Bond) |
| | | 80.0 | | | ○ | | |
| | | 81.4 | ○ | | | 70 | |
| | | 90.0 | | | ○ | | |
| | | 90.3 | | ○ | | | 24(Bond) |
| | | 100.0 | | | ○ | | |
| | | 104.7 | ○ | | | 90 | |
| | | 105.4 | | ○ | | | 28(Bond) |
| THICK PAPER1 | 106～163 | 120.0 | | | ○ | | |
| | | 120.4 | | ○ | | | 32(Bond) |
| | | 127.9 | ○ | | | 110 | |
| | | 135.3 | | ○ | | | 50(Cover) |
| | | 157.0 | ○ | | | 135 | |
| | | 160.0 | | | ○ | | |
| | | 162.4 | | ○ | | | 60(Cover) |
| | | 162.9 | | ○ | | | 90(Index) |
| THICK PAPER2 | 164～209 | 175.9 | | ○ | | | 65(Cover) |
| | | 199.1 | | ○ | | | 110(Index) |
| | | 200.0 | | | ○ | | |
| | | 209.3 | ○ | | | 180 | |
| THICK PAPER3 | 210～256 | 216.5 | | ○ | | | 80(Cover) |
| | | 220.0 | | | ○ | | |
| | | 250.0 | | | ○ | | |
| | | 255.9 | ○ | | | 220 | |
| THICK PAPER4 | 257～300 | 280.0 | | | ○ | | |
| | | 300.0 | | | ○ | | |

FIG.2

| PAPER TYPE | GRAMMAGE DIVISION (g/m²) | GRAMMAGE (g/m²) | DISTRIBUTION | | | REAM WEIGHT BY KILOGRAM (kg) | REAM WEIGHT BY U.S. POUND (lbs.) |
|---|---|---|---|---|---|---|---|
| | | | JAPAN | NORTH AMERICA | EUROPE | | |
| PLAIN PAPER | 64～105 | 64.0 | ○ | | | 55 | |
| | | 75.3 | | ○ | | | 20(Bond) |
| | | 80.0 | | | ○ | | |
| | | 81.4 | ○ | | | 70 | |
| | | 90.0 | | | ○ | | |
| | | 90.3 | | ○ | | | 24(Bond) |
| | | 100.0 | | | ○ | | |
| | | 104.7 | ○ | | | 90 | |
| | | 105.4 | | ○ | | | 28(Bond) |
| THICK PAPER1 | 106～163 | 120.0 | | | ○ | | |
| | | 120.4 | | ○ | | | 32(Bond) |
| | | 127.9 | ○ | | | 110 | |
| | | 135.3 | | ○ | | | 50(Cover) |
| | | 157.0 | ○ | | | 135 | |
| | | 160.0 | | | ○ | | |
| | | 162.4 | | ○ | | | 60(Cover) |
| | | 162.9 | | ○ | | | 90(Index) |
| THICK PAPER2 | 164～209 | 175.9 | | ○ | | | 65(Cover) |
| | | 199.1 | | ○ | | | 110(Index) |
| | | 200.0 | | | ○ | | |
| | | 209.3 | ○ | | | 180 | |
| THICK PAPER3 | 210～256 | 216.5 | | ○ | | | 80(Cover) |
| | | 220.0 | | | ○ | | |
| | | 250.0 | | | ○ | | |
| | | 255.9 | ○ | | | 220 | |
| THICK PAPER4 | 257～300 | 280.0 | | | ○ | | |
| | | 300.0 | | | ○ | | |

IMAGE FORMING APPARATUS AND METHOD OF SETTING PRINTING CONDITION IN THE SAME

BACKGROUND OF THE INVENTION

1. Field of the Invention

The present invention relates to an image forming apparatus that forms an image on a recording medium and a method of setting a printing condition in the image forming apparatus.

2. Description of the Related Art

Various types of paper such as thin paper and thick paper are used in an MFP (Multi Function Peripheral). An amount of toner deposited on paper, a fixing temperature, a conveying speed of paper, and the like vary depending on paper types. Therefore, the MFP holds data of plural types of paper type groups classified in accordance with grammages, which are weights of paper per a predetermined area. The MFP sets an appropriate printing condition for paper on which an image is about to be printed on the basis of the data. Selection of a paper type group is performed by a user. However, it is also attempted to identify a paper type with a media sensor provided in the apparatus.

Conventionally, there is known an image forming apparatus that changes respective control conditions on the basis of information on manufacturers, model numbers, basis weights of paper information data with reference to control data, estimates a paper surface state and a paper thickness of a transfer paper during paper passage with an optical sensor provided in a paper passing section, and corrects an amount of change according to values of the paper surface state and the paper thickness (JP-A-2003-84507).

There is also known an image forming apparatus including paper type detecting means for automatically discriminating a paper type and setting means with which a user sets image forming conditions including the paper type (JP-A-2003-29581, U.S. Pat. No. 6,996,349, and U.S. Pat. No. 6,718,145). This image forming apparatus suspends an image forming operation when a set condition concerning the paper type and paper type detection information are different.

BRIEF SUMMARY OF THE INVENTION

It is an object of the present invention to provide an image forming apparatus that forms an image on a recording medium.

In an aspect of the present invention, the image forming apparatus includes a fixing unit, a media sensor that is provided further upstream in a conveying direction of the recording medium than this fixing unit and detects thickness of a recording medium, an operation panel for selecting a group to which the recording medium to be subjected to image formation belongs out of plural groups of the recording media classified according to grammages, a classification processing unit that sub-classifies the group, to which the recording medium belongs, selected via the operation panel into plural sub-groups according to a detection result in the media sensor, a holding unit that holds data in fixing temperature ranges set for each of the plural groups and each of the plural sub-groups, and a control unit that sets, for the recording medium belonging to the group selected, a temperature of the fixing unit to a fixing temperature in the fixing temperature range and controls this fixing temperature according to any one of the sub-groups sub-classified by the classification processing unit.

DESCRIPTION OF THE DRAWINGS

FIG. 2 is a table in which types of paper available to users in Japan, the North America, and Europe are compared;

DETAILED DESCRIPTION OF THE INVENTION

Figure 1:
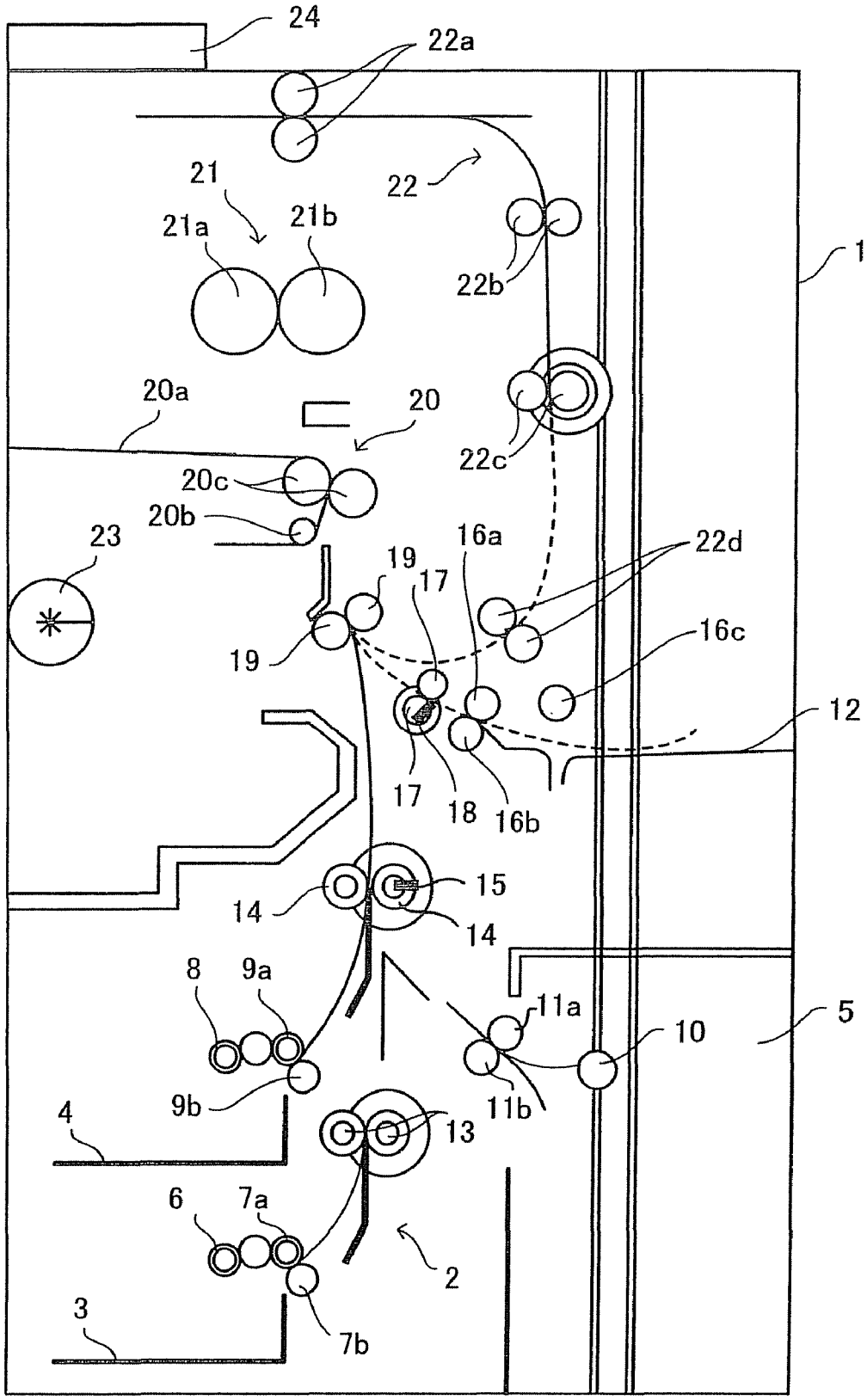
FIG. 1 is a schematic diagram of an apparatus main body including an image forming apparatus according to a first embodiment of the present invention.

Throughout this description, the embodiments and examples shown should be considered as exemplars, rather than limitations on the apparatus and methods of the present invention.

Embodiments of the present invention will be hereinafter explained in detail with reference to the accompanying drawings.

In the figures, identical components are denoted by identical reference numerals and signs and redundant explanations of the components are omitted.

As shown in FIG. 1, an image forming apparatus according to a first embodiment of the present invention is provided in an apparatus main body 1 of an MFP. In the apparatus main body 1, a fixing unit 21, media sensors 15 and 18, an operation panel 24, and a control unit and a classification processing unit (or a discriminating unit), which are described later, are provided. Functions of the control unit and the classification processing unit are realized by a CPU (Central Processing Unit), a ROM, a RAM, and LSI, and the like.

In a lower part of the apparatus main body 1, a cassette device 3 and a cassette device 4 provided above this cassette device 3 are provided. Plural pieces of paper are stored in these cassette devices 3 and 4. Pickup rollers 6 and 8 for taking out the paper are provided on sides of the cassette devices 3 and 4, respectively.

In the apparatus main body 1, a paper conveying path 2 extending upward from the cassette device 3 through the cassette device 4, a pair of registration rollers 19, and a secondary transfer unit 20 is formed. In a lower part of this conveying path 2, a paper feeding roller 7*a* for drawing up the paper stored in the cassette device 3, a separating roller 7*b* opposed to this paper feeding roller 7*a* and used for separating the paper piece by piece, and a pair of conveying rollers 13 that nip and convey one piece of paper separated are provided. Between the conveying path 2 and the cassette device 4, a paper feeding roller 9*a* and a separating roller 9*b* for separating the paper are provided.

In the conveying path 2 above these paper feeding roller 9*a* and separating roller 9*b*, a pair of relaying rollers 14 that nip and convey paper conveyed from the cassette devices 3 and 4 and an LCF device 5 described later are provided. The media sensor 15 is attached near one relaying roller 14. This media sensor 15 is provided further upstream in a conveying direction of the paper than the fixing unit 21 and detects a paper thickness or the thickness of a film or the like.

Specifically, as the media sensor 15, it is possible to use (a) a media sensor that estimates a paper thickness by measuring the transmittance of light, (b) a media sensor that estimates the thickness of paper with a sensor capable of detecting a very small displacement, and the like. When the media sensor 15 of (b) is used, since a paper thickness is directly measured, it is possible to obtain paper thickness information with high accuracy.

As a detection principle of (b), there are an optical system, a magnetic resistance system, and the like. As a media sensor employing a measurement method of the optical system, a range finding sensor employing the principle of triangular range finding is known. The range finding sensor is called, for example, a PSD (Position Sensitive Detector). The range finding sensor irradiates light from a light emitting element on paper and performs distance measurement according to a position of incidence of reflected light from the paper on the sensor. A measurement method using the range finding sensor is described in detail in, for example, Japanese Patent No. 3524755. With this range finding sensor, it is possible to directly measure a paper thickness and it is also possible to measure a vertical displacement of relaying rollers using the range finding sensor and indirectly measure a paper thickness.

A media sensor employing the measurement method of the magnetic resistance system converts a very small displacement of rollers into a movement of a magnet. The media sensor makes use of a change in a resistance of an electric circuit arranged near this media sensor responding to a change in intensity of a magnetic field. The media sensor measures displacements of the rollers according to a change in a voltage of a resistor. The media sensor employing the measurement method of the magnetic resistance system has a mechanism for transmitting vertical movement of the rollers before and after paper passes through the rollers to the magnet via a lever or the like.

As both the media sensor 15 and the media sensor 18 described below, which are used by the image forming apparatus of the present invention, media sensors based on any estimation principles other than (a) and (b) may be used.

As objects of detection of paper by the media sensor 15, there are physical properties such as a paper thickness and a light transmittance other than a grammage. The grammage represents a reference weight of paper and paperboard and means a mass per a unit area. In other words, the grammage is obtained by converting an area and a mass of paper measured into values per a unit area. A unit of the grammage is $g/m^2$. Usually, it can be said that paper with a large grammage is "thick", "heavy", "sturdy (strong)", and "hard" paper. Conversely, it can be said that paper with a small grammage is "thin", "light", "unsturdy (weak)", and "soft" paper.

A list concerning Japan, the North America, and Europe in which comparison of sheets mainly distributed in the markets is indicated by circles is shown in FIG. 2. An image forming apparatus determines paper type data according to products distributed in the respective regions and holds this paper type data in a holding unit. All fixing conditions in the image forming apparatus have to be associated with each of "types of grammages". However, since there are many "types of grammages", the fixing conditions are complicated and it is not realistic to make those conditions. Therefore, the "types of grammages" are enclosed in fixed ranges and fixing conditions are set for each of these "grammage divisions". In the holding unit, image forming conditions for each of the grammage divisions for setting grammages in a predetermined range as a predetermined grammage division, for example, the data of fixing conditions are held.

An output of the media sensor 15 is sent to the classification processing unit. This classification processing unit sub-classifies a group to which paper selected via the operation panel 24 belongs into plural sub-groups according to a detection result in the media sensor 15. In the image forming apparatus according to this embodiment, the classification processing unit further sub-classifies a paper type group (I) selected by the user into paper type groups (II). When, for example, plain paper is selected as the paper type group (I), the classification processing unit classifies this plain paper into two paper type groups (II), namely, "plain paper 1" and "plain paper 2".

The holding unit holds data of image forming conditions corresponding to the respective sub-groups in addition to the image forming conditions for each of the grammage divisions. In other words, data of fixing temperature ranges set for each of the plural sub-groups such as the plain paper 1 and the plain paper 2 is held in the holding unit.

The control unit reads out the data in the holding unit concerning paper detected by the media sensor 15 and controls a fixing temperature of the fixing unit 21 according to the image forming conditions. Consequently, fine tuning suitable for a paper type is performed. Here, the grammage divisions may be classified such that an interval between grammages adjacent to each other of different types of paper is set in the center of a wide section. Optimum image forming conditions are transmitted to the control unit according to the sub-group discriminated by the classification processing unit.

In a lower part of the apparatus main body 1, an LCF (Large Capacity Feeder) device 5 for storing a large number of pieces of paper is provided. In the inside of the LCF device 5, a pickup roller 10 is provided. Between this pickup roller 10 and the conveying path 2, a paper feeding roller 11*a* for paper feeding and a separating roller 11*b* for separation of paper are provided. Above the LCF device 5, an SFB (Stack Feed Bypass) device 12 for manual feed is provided. Paper stored in this SFB device 12 is fed in by a pickup roller 16*c* and a paper feeding roller 16*a* and separated piece by piece by a separating roller 16*b* for separation of paper. The paper separated is conveyed to the conveying path 2 side. Between these paper feeding roller 16*a* and separating roller 16*b* and the conveying path 2, a pair of relaying rollers 17 that nip and convey the paper to be conveyed are provided. Near one relaying roller 17, the media sensor 18 that is attached to be opposed to the surface of the paper and has the same function as the media sensor 15 is provided.

The pair of registration rollers 19 that temporarily stop paper in order to adjust a position and a direction of the paper and convey the paper to the secondary transfer unit 20 are provided in the conveying path 2 above the pair of relaying rollers 17.

On one side in the center in a height direction of the apparatus main body 1, a photoconductive drum 23 driven to rotate by a motor is provided. A toner image deposited on a latent image on this photoconductive drum 23 is transferred onto an endless transfer belt 20*a*. The secondary transfer unit 20 that transfers the toner image on the photoconductive drum 23 onto paper is constituted by this transfer belt 20*a*, a tension roller 20*b* that gives a tension to the transfer belt 20*a*, and a pair of secondary transfer rollers 20*c* that carry the transfer belt 20*a*.

The fixing unit 21 that fixes the toner image, which is transferred onto the paper, on the paper is provided above this secondary transfer unit 20. This fixing unit 21 has a heat roller 21*a* that conveys paper in a state in which heat is applied to the paper and a press roller 21*b* that conveys paper in a state in which a pressure is applied to the paper. The fixing unit 21 changes a fixing temperature in accordance with a command from the control unit. The fixing unit 21 stays on standby at a standby temperature determined according to a paper type until a command for start of fixing is received from the control unit. This standby temperature is controlled by the control unit.

Paper print-outputted from the fixing unit 21 is stored in a discharge tray. Four pairs of conveying rollers 22*a*, 22*b*, 22*c*, and 22*d* are provided along one side of the apparatus main body 1 from an upper part of the apparatus main body 1. An ADU (Automatic Duplex Unit) 22 that reverses paper, which has passed the fixing unit 21, and leads the paper to the pair of registration rollers 19 again is constituted by the conveying rollers 22*a* to 22*d* and a mechanism for driving to rotate these rollers.

The operation panel 24 that is used for selecting a type of paper and also used for display of information and data setting is attached on the upper surface of the apparatus main body 1. With the operation panel 24, the user is capable of selecting a group to which paper to be subjected to image formation belongs out of the plural groups of paper classified according to grammages. The operation panel 24 is connected to the control unit.

In a method of setting a printing condition of the present invention, the user selects a type of paper with the operation panel 24 and the control unit sets the fixing unit 21 at a standby temperature determined according to the paper type group (I). The media sensor 15 detects the thickness of the paper and outputs a voltage corresponding to the thickness of the paper. The classification processing unit performs discrimination of the paper type group (II) according to this thickness of the paper. For example, the user selects "plain paper" set as the paper type group (I). The media sensors 15 and 18 output a voltage representing "paper thickness ≦0.100 mm". The classification processing unit discriminates, according to this voltage value, that the paper detected is the "plain paper 1" belonging to the paper type group (I). This "plain paper 1" is one kind of paper in the paper group (II) sub-classified. Similarly, when the media sensors 15 and 18 output, for example, a voltage representing "0.100<paper thickness", the classification processing unit discriminates that the paper detected is the "plain paper 2" belonging to the paper type group (I). This "plain paper 2" is also one kind of paper of the paper type group (II). When such discrimination is performed, the control unit adjusts the temperature of the fixing unit 21 such that the standby temperature of the fixing unit 21 changes to a temperature corresponding to the paper type group (II) discriminated.

Figure 3:
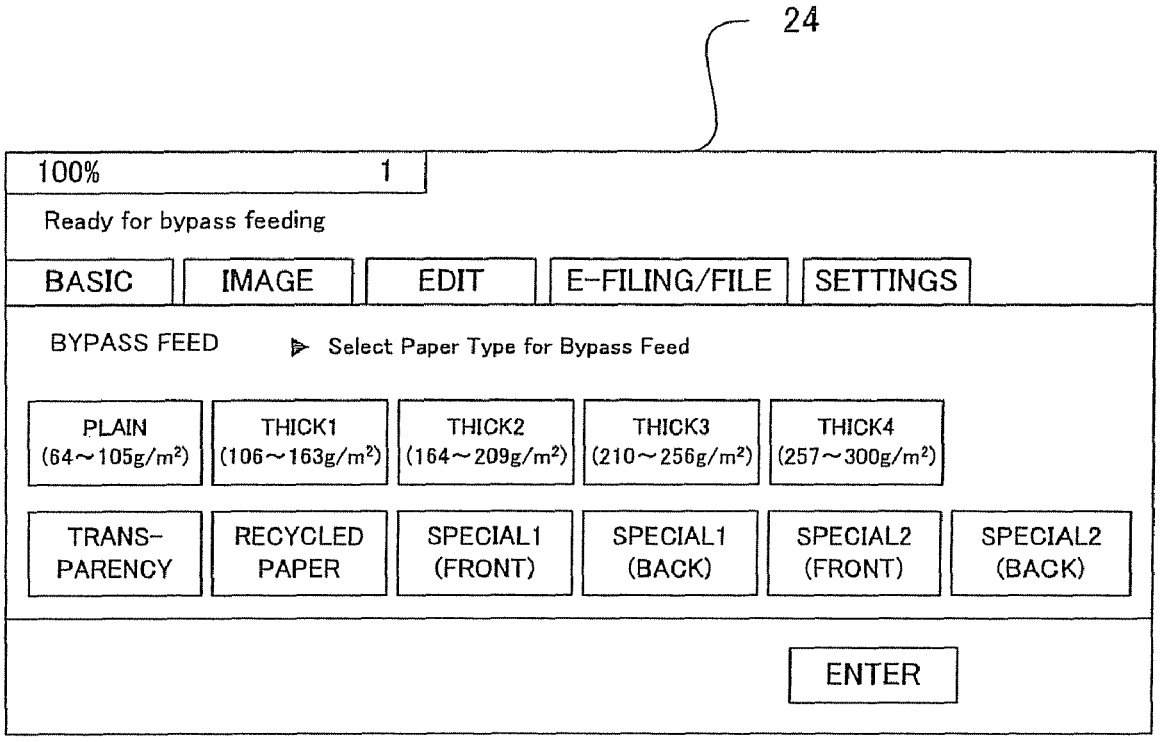
FIG. 3 is a diagram showing an example of screen display of an operation panel of the image forming apparatus according to the first embodiment of the present invention.

An example will be described in which, in the apparatus main body 1 constituted as described above, the image forming apparatus according to this embodiment prints images on plural pieces of plain paper fed to the cassette devices 3 and 4, the LCF device 5, or the SFB device 12 by the user. The user sets a paper type "plain paper" in the device main body 1 using the operation panel 24. FIG. 3 is a diagram showing an example of screen display of the operation panel 24 of the image forming apparatus according to the first embodiment of the present invention. When the user depresses any one of plural touch keys on the operation panel 24, the image forming apparatus recognizes a type of paper to be subjected to image formation. Besides a key for plain paper, keys for thick paper 1, thick paper 2, thick paper 3, and thick paper 4 are provided on the operation panel according to grammages.

First, the image forming apparatus processes first piece of paper. When plain paper is selected, the image forming apparatus starts an image forming process on the basis of various set conditions determined in advance as an image forming process for the plain paper. The apparatus main body 1 starts, at predetermined timing, paper feed from a paper feeding device in which the plain paper is stored among the cassette device 3, 4 and the SFB device 12.

When the paper fed is conveyed to the position of the media sensor 15 or 18 in FIG. 1, the media sensor 15 or 18 detects the presence of the paper. The control unit identifies a paper type on the basis of a voltage outputted from the media sensor 15 or 18. In this identification processing, the classification processing unit discriminates this plain paper more in detail in the group of the plain paper. For example, in a grammage range of the plain paper represented by FIG. 2, it is identified whether the plain paper is paper belonging to a range on a side on which the paper thickness is large (plain paper 2) or paper belonging to a range on a side on which the paper thickness is small (plain paper 1). In other words, setting and the like of paper types and rough classification of the paper types are performed by the user and more detailed classification of paper types for the paper types classified is performed by the media sensor 15 or 18.

Identification information concerning the paper types is fed back to plural units located further downstream in the conveying direction than the media sensors 15 and 18. In this embodiment, a transfer bias voltage in the secondary transfer unit 20 and temperature in the fixing unit 21 are subjected to feedback control, respectively.

Operations of the fixing unit 21 in the case in which paper to be conveyed is plain paper will be explained. The fixing unit 21 tunes temperature setting for the fixing unit 21 to a condition optimum for the plain paper 1 or the plain paper 2 on the basis of information on the paper type group (II) identified by the media sensor 15 or 18.

Figure 4:
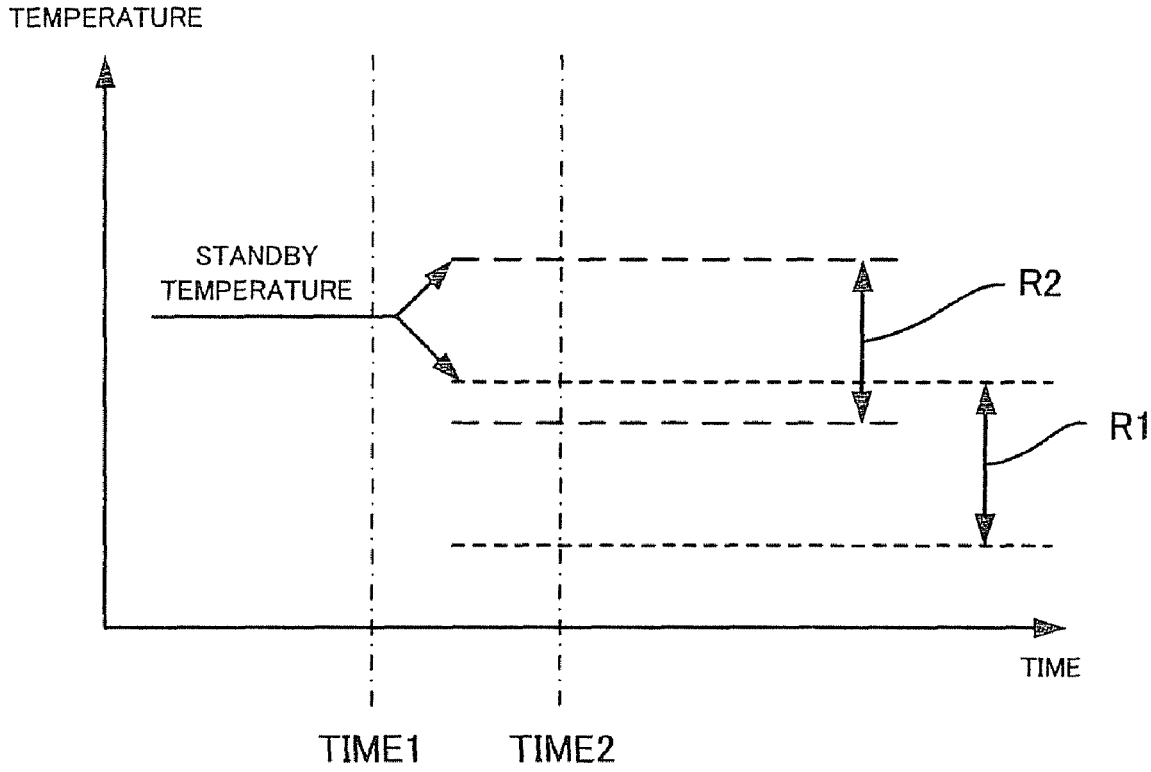
FIG. 4 is a graph for explaining transition processing for a standby temperature by a control unit of the image forming apparatus according to the first embodiment of the present invention.

FIG. 4 is a diagram for explaining transition processing for a standby temperature by the image forming apparatus according to this embodiment in the case in which the paper group (I) is "plain paper". Temperature ranges R1 and R2 respectively represent fixable temperature ranges for the plain paper 1 and the plain paper 2. The control unit sets the standby temperature of the fixing unit 21 to temperature having a value between an upper limit value of the temperature range R1 and an upper limit value of the temperature range R2 in a period from start of an operation to TIME1 when paper reaches the position of the media sensor 15. A method of setting this standby temperature will be described later. During the period from the operation start to TIME1, the fixing unit 21 continues to stay on standby under a condition of the standby temperature. The control unit lowers the fixing temperature for thin paper and raises the fixing temperature for thick paper in a period from TIME1 to TIME2 when the paper reaches the fixing unit 21.

Consequently, the control unit transitions the standby temperature for the plain paper to temperature under an optimum temperature condition. When the image forming apparatus forms images on the thick paper 1 to the thick paper 4, as in the case of the plain paper, the control unit transitions the standby temperature to an optimum temperature. The image forming apparatus continues to print images on second and subsequent pieces of paper under the same condition as the first piece of paper.

In this way, the image forming apparatus according to this embodiment performs fine tuning for paper present in the plural units further downstream in the conveying direction than the media sensor 15. Thus, the user is capable of setting more appropriate conditions than conditions set using the operation panel 24.

A method of setting the standby temperature will be described.

When the fixing temperature is set to a high temperature, because of a phenomenon called high-temperature offset, a toner adheres to the rollers in the fixing unit 21 and a part of a toner image on paper disappears or the paper sticks to the rollers in the fixing unit 21. When the fixing temperature is set to a low temperature, low-temperature offset and paper clog occur. Therefore, the fixing temperature of the fixing unit 21 needs to be in a non-offset temperature region in which fixing is guaranteed and the high-temperature offset and the low-temperature offset do not occur.

Figure 5:
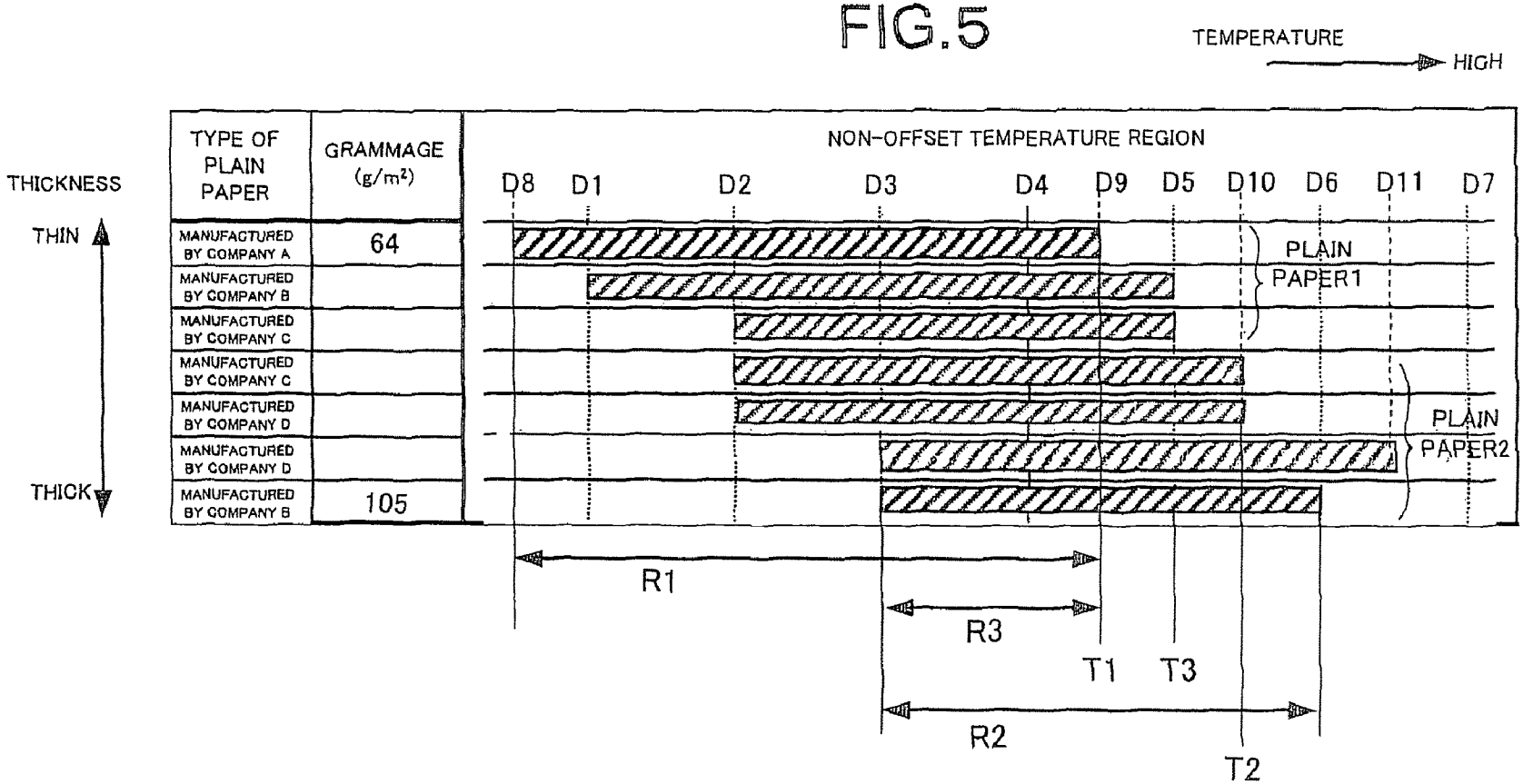
FIG. 5 is a diagram showing an example of a non-offset temperature region of plain paper.

An example of a non-offset temperature region of plain paper is shown in FIG. 5. As shown in FIG. 5, it is possible to fix an image on the plain paper 1 belonging to the range on a small grammage side at a low temperature. An image is not fixed on the plain paper 2 on a large grammage side unless the fixing temperature is set to a high temperature. In other words, since the temperature ranges R1 and R2 are different, a temperature range R3 where the temperature ranges R1 and R2 overlap each other is extremely narrow.

When it is determined that paper set in all the paper feeding cassettes set as detection objects by the media sensor 15 is the plain paper 1, the image forming apparatus according to this embodiment sets the standby temperature to temperature for the plain paper 1. Conversely, when it is determined that paper in all the paper feeding cassettes is the plain paper 2, the image forming apparatus sets the standby temperature to temperature for the plain paper 2. Since time required for raising and lowering temperature is not consumed, it is possible to fix images on paper at a proper temperature from a first piece of paper. The image forming apparatus does not need to stop processing for printing an, image on paper until the fixing unit 21 reaches a proper temperature. For example, as in high-speed processing for color printing, even when a fixable temperature range is narrow, the image forming apparatus can perform print processing at an appropriate temperature.

The image forming apparatus may set the standby temperature to an upper limit temperature D9 at which the plain paper 1 is not offset. After the control unit sets the standby temperature to D9 once, when the plain paper 2 passes the media sensor 15 or 18, the control unit raises the standby temperature. Since an upper limit temperature D9 or D5 of the plain paper 1 is higher than a lower limit temperature D2 or D3 of the plain paper 2, even if the plain paper 2 reaches the fixing unit 21 while the standby temperature is kept, offset does not occur. For the plain paper 1, since it is unnecessary to lower temperature from the standby temperature, an energy loss caused by the fixing unit 21 waiting at a higher temperature is not caused. Operations in the case in which the media sensor 18 is used are the same as those in the case in which the media sensor 15 is used.

In this way, according to the image forming apparatus according to this embodiment, since a fixing temperature of paper having a grammage on an upper limit side and a fixing temperature of paper having a grammage on a lower limit side, which belong to the same paper type group, are changed on the basis of signal data from the media sensor 15, it is possible to perform tuning optimum for a paper type.

In the image forming apparatus according to this embodiment, a fixing temperature of thinner paper and a fixing temperature of thicker paper are controlled to lower the temperature in the case of thin paper and raise the temperature in the case of thick paper. Thus, it is possible to increase the number of paper types that are substantially processable.

Second Embodiment

An image forming apparatus according to a second embodiment of the present invention performs fine tuning such as temperature control for the fixing unit 21 and control of a transfer bias voltage in the secondary transfer unit 20 on the basis of a formula that associates a paper thickness and a fixing temperature. This image forming apparatus holds, in a holding unit, data indicating a relation of a formula T=f(W) represented by using an optimum temperature T and a paper thickness W. It can be said that the image forming apparatus uses, for tuning of a printing condition, the paper thickness as a scale. In the image forming apparatus according to this embodiment, a temperature determining unit is provided which determines temperature suitable for fixing of an image on paper on the basis of information on thickness detected by a media sensor and the relation of the formula T=f(W). A control unit shifts a fixing temperature of the fixing unit 21 to temperature determined by this temperature determining unit.

When a user operates touch keys on the operation panel 24, a paper type group is selected in the image forming apparatus.

The apparatus main body 1 starts an image forming process on the basis of various set conditions in the fixing unit 21 and the secondary transfer unit 20 determined according to the paper type group selected. Consequently, a feeding operation for paper on a tray in a cassette or the SFB device 12 is started at predetermined timing.

When the paper fed reaches the position of the media sensor, the media sensor outputs a voltage corresponding to a paper thickness. This voltage changes according to the paper thickness. The classification processing unit can learn the paper thickness according to a voltage value. This output voltage is also paper thickness information. This paper thickness information is notified to units provided further downstream in a conveying direction than the media sensor.

The fixing unit 21 tunes a setting on the basis of the paper thickness information from the media sensor such that a fixing temperature is a condition optimum for the paper. In the image forming apparatus according to this embodiment, as in FIG. 4, a standby temperature is set to be an intermediate condition in a paper type group already selected by the user until TIME1 when the paper reaches the media sensor. After the media sensor outputs a paper thickness signal, the control unit calculates the formula T=f(W). The control unit transitions temperature such that the fixing unit 21 is set under a condition optimum for the paper thickness by TIME2 when the paper reaches the fixing unit 21, thereby, optimum fixing temperature can be obtained.

The tuning of temperature in the first embodiment is tuning for creating more detailed plural paper type groups from one paper type group. When the image forming apparatus creates more detailed paper type groups using the tuning in the first embodiment, the image forming apparatus may err in discrimination concerning whether paper detected by the media sensor belongs to a group higher than a threshold set for creating respective groups or belong to a group lower than the threshold. When the image forming apparatus errs in this discrimination, there is a risk in that the fixing unit 21 and the secondary transfer have their setting conditions substantially deviated from the setting conditions. In particular, when the image forming apparatus uses a grammage as a scale in creating detailed paper type groups, it is highly likely that misdiscrimination of a paper type occurs because of a difference between the scale and a scale obtained by the media sensor.

According to the method of setting a printing condition according to this embodiment, since conditions are set according to a formula, it is possible to prevent the risk of occurrence of misdiscrimination of a paper type and it is possible to perform finer tuning proportional to a paper thickness.

Third Embodiment

In the first embodiment and the second embodiment, the control unit changes the set conditions of the fixing unit 21 and the secondary transfer unit 20 on the basis of a signal detected in the media sensor 15 or 18. An image forming apparatus according to a third embodiment of the present invention causes the media sensor 15 or 18 in the first embodiment and the media sensor in the second embodiment to function as checking means for checking whether a paper type set using the operation panel 24 and a type of paper conveyed are the same.

In the image forming apparatus according to this embodiment, the control unit checks whether a type of paper detected by these media sensors and a paper type set using the operation panel 24 are the same. When it is determined that the type of the paper is different from the paper type set, the image forming apparatus stops conveyance of the paper before an image is transferred onto the paper, performs image formation processing again, and prints an image formed again on the paper.

Units other than these among units constituting the image forming apparatus are the same as the units used in the image forming apparatuses according to the first and the second embodiment.

With such a structure, when the user correctly sets, in the image forming apparatus, paper types of paper stored in the cassette devices 3 and 4 and the like, the image forming apparatus performs print setting processing same as that in the first and the second embodiments. When the user sets wrong contents in the image forming apparatus, the image forming apparatus recreates data of images formed to that point such as toner images formed on the photoconductive drum 23 and the transfer belt 20*a*. The image forming apparatus puts paper on standby near the pair of registration rollers 19. When an image is formed again, the image forming apparatus resumes conveyance of the paper from a stop position of the paper, conveys the paper to the secondary transfer unit 20, and fixes the image on the paper in the fixing unit 21.

When the user does not notice a grammage written on a package of paper, it is difficult for the user to identify the grammage of the paper. The same holds true when, after the paper is taken out from the package, the user feeds those pieces of paper to the cassette device 3 and the like. In the image forming apparatus according to this embodiment, even when a paper type is set by mistake, it is possible to perform printing that does not waste paper. Moreover, in the image forming apparatus according to this embodiment, a machine can automatically set a paper type and automatically convey paper. Therefore, the user does not have to perform work for taking out paper caught in the machine because of, for example, paper clog from the machine.

It can be said that the function of the media sensors 15 and 18 in the first and the second embodiments is a function of performing fine tuning. However, it can be said that the function of the media sensors 15 and 18 according to this embodiment is a function of checking right and wrong of a paper type selected by the user.

Fourth Embodiment

As in the third embodiment, an image forming apparatus according to a fourth embodiment of the invention uses the media sensors 15 and 18 in the first embodiment and the media sensor in the second embodiment as checking means for checking whether a paper type set using the operation panel 24 and a paper type of paper conveyed are the same. In the image forming apparatus according to this embodiment, when a paper type identified by the media sensors 15 and 18 and a paper type set by the user are different, the image forming apparatus discharges the paper without forming an image on the paper.

Units constituting the image forming apparatus according to this embodiment are the same as the units used in the image forming apparatuses according to the first and the second embodiments except these points.

With such a structure, when it is determined that a paper type identified by the media sensors 15 and 18 and a paper type set by the user are different, the image forming apparatus directly discharges the paper.

In this way, in the image forming apparatus according to the fourth embodiment of the present invention, even when the user errs in setting, labor and time of the user for removing stopped paper are saved. It is possible to reuse the paper discharged. As in the third embodiment, the media sensors 15 and 18 according to this embodiment check right and wrong of a paper type selected by the user.

In the respective embodiments described above, the feedback control of fine tuning is applied to the fixing unit 21 and the secondary transfer unit 20. However, the image forming apparatus of the present invention can also apply the feedback control to processing by a finisher provided on the outside of the apparatus main body 1. This finisher performs post-processing for paper such as a stapler that stales pages, a puncher that drills holes in paper, or a sorter that sorts paper. The image forming apparatus of the present invention may control respective values such as a setting of the number of pieces of paper stapled by the stapler, an electric current of a brake of a motor that drives punching means in the puncher, and a discharge speed of paper in the sorter according to a paper thickness.

In the embodiments described above, there are various methods as a method of determining paper type data.

The image forming apparatus of the invention can form an image on an arbitrary recording medium such as a sheet-like medium.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus comprising:

an operation panel configured to receive a selection from plural groups of recording medium classified according to grammage;

a media sensor configured to detect thickness of a recording medium;

a classification processing unit configured to select a subgroup in the group according to the thickness detected by the media sensor;

a fixing unit configured to fix a toner image on the recording medium detected by the media sensor; and a control unit configured to set a standby temperature of the fixing unit at an intermediate temperature between a fixing upper limit temperature for a thinnest recording medium in the group and a fixing upper limit temperature for a thickest recording medium in the group after the operation panel receives the selection and before the media sensor detects the thickness.

2. An image forming apparatus according to claim 1, wherein the control unit configured to set a standby temperature of the fixing unit at a first fixing upper limit temperature for thinnest recording media that are set in plural paper feeding stages and belong to a thinnest side sub-group, and set a standby temperature at a second fixing upper limit temperature for thickest recording media that are set in the paper feeding stages and belong to a thickest side sub-group after the operation panel receives the selection and before the media sensor detects the thickness.

3. An image forming apparatus according to claim 2, further comprising:

a temperature determining unit configured to determine a fixing temperature according to the thickness detected by the media sensor and formula data that relates the thickness and the fixing temperature.

4. An image forming apparatus according to claim 1, further comprising:

a temperature determining unit configured to determine a fixing temperature according to the thickness detected by the media sensor and formula data that relates the thickness and the fixing temperature.

5. An image forming apparatus according to claim 4, wherein the control unit stops conveyance of the recording medium of which a type of the group determined by the thickness is different from a type of the selected sub-group, causes an image forming unit to form an image matched to the determined group again, resumes the conveyance.

6. An image forming apparatus according to claim 4, wherein the control unit discharges the recording medium of which a type of the group determined by the thickness is different from a type of the selected sub-group.

7. An image forming apparatus according to claim 1, further comprising:

a temperature determining unit configured to determine a fixing temperature according to the thickness detected by the media sensor and formula data that relates the thickness and the fixing temperature.

8. An image forming apparatus according to claim 1, wherein the control unit stops conveyance of the recording medium of which a type of the group determined by the thickness is different from a type of the selected sub-group, causes an image forming unit to form an image matched to the determined group again, resumes the conveyance.

9. An image forming apparatus according to claim 1, wherein the control unit discharges the recording medium of which a type of the group determined by the thickness is different from a type of the selected sub-group.

10. An image forming apparatus comprising:

an operation panel configured to receive a selection from plural groups of recording medium classified according to grammage;

a media sensor configured to detect thickness of a recording medium;

a classification processing unit configured to select a sub-group in the group according to the thickness detected by the media sensor;

a fixing unit configured to fix a toner image on the recording medium detected by the media sensor; and a control unit configured to set a standby temperature of the fixing unit at a fixing upper limit temperature for a thinnest recording medium in the group after the operation panel receives the selection and before the media sensor detects the thickness.

* * * * *